US006412201B1

(12) United States Patent
Traen

(10) Patent No.: US 6,412,201 B1
(45) Date of Patent: Jul. 2, 2002

(54) SWIMMER'S LAP COUNTER DEVICE

(76) Inventor: Dan Traen, 13060 E. Firestone Blvd., Santa Fe Springs, CA (US) 90670-5515

( * ) Notice: Subject to any disclaimer, the term of this patent is extended or adjusted under 35 U.S.C. 154(b) by 0 days.

(21) Appl. No.: 09/611,107

(22) Filed: Jul. 6, 2000

(51) Int. Cl.[7] ..... G09F 7/22
(52) U.S. Cl. ..... 40/533; 16/223
(58) Field of Search ..... 40/533, 598, 492, 40/500, 531, 532, 610, 455; 235/127; 15/143.1; 116/222, 223, 63 R

(56) References Cited

U.S. PATENT DOCUMENTS

| | | | | | |
|---|---|---|---|---|---|
| 521,889 | A | * | 6/1894 | Phillips | 235/127 |
| 2,065,624 | A | * | 12/1936 | Summers | 116/223 |
| 2,706,352 | A | * | 4/1955 | Clark | 40/492 |
| 3,246,411 | A | * | 4/1966 | Aafedt | 116/222 |
| 3,394,674 | A | * | 7/1968 | Downing | 116/63 R |
| 3,633,297 | A | * | 1/1972 | Gutmann | 40/492 |
| 3,928,928 | A | * | 12/1975 | Kalust | 40/455 |
| 4,094,083 | A | * | 6/1978 | Fund | 40/533 |
| 4,114,321 | A | | 9/1978 | Jarvis et al. | |
| 4,222,190 | A | | 9/1980 | Solomon | |
| 4,518,266 | A | | 5/1985 | Dawley | |
| 4,700,369 | A | | 10/1987 | Siegal et al. | |
| 4,999,938 | A | * | 3/1991 | Behling | 40/610 |
| 5,285,428 | A | | 2/1994 | Rosow et al. | |
| 5,634,232 | A | * | 6/1997 | Brenneman | 15/143.1 |

* cited by examiner

*Primary Examiner*—Lynne H. Browne
*Assistant Examiner*—Doug Hutton
(74) *Attorney, Agent, or Firm*—Dean A. Craine

(57) ABSTRACT

A lap counter device used to show swimmers how many laps they have swum. The device includes a manual, flip-style lap counter and a rigid, planar body with an upward extended neck with a threaded bore formed therein that attaches to an elongated pole. The planar body has parallel front and back surfaces designed to hold lap counter pages in a vertical position adjacent to the edge of the pool when the planar body is held upright. The pole acts as a handle for an assistant to hold the planar body at or below the waterline while standing next to the pool. The planar body has adjustment knobs located one pair on the front surface and one pair on the back surface. During use, the pages of the lap counter are vertically positioned on the planar body so that the upper slots formed on the pages are aligned around the adjustment knobs on both sides of the planar body. The knobs can be selectively turned from a blocking to a non-blocking position, which allows the pages to be securely locked in position when placed in the water, or manually turned to indicate a new lap.

18 Claims, 3 Drawing Sheets

SWIMMER'S LAP COUNTER DEVICE

BACKGROUND OF THE INVENTION

1. Field of the Invention

This invention pertains to swimming accessories, and more specifically, to manually operated, flip-style lap counters held along the side of a pool for viewing by a swimmer.

2. Description of the Related Art

Current manual, flip-style lap counters consist of two sets of pages with numbers printed on one side that are held along the side of a pool for viewing by a swimmer to indicate the current lap. For the swimmer to view the lap counter, a swimmer's assistant must temporarily hold it at or below water level, and then lift it out of the water to turn one or both pages on the lap counter to indicate the next lap.

Flip-style lap counters include a planar, rigid base member with two stacks of pages pivotally connected together along their outer edges to the base member. A single digit is printed on the front surface of each page and on the front surface of the base member. During use, the pages in each stack pivot around the outer edges of the base member to display the single digit on the front surface on a lower page or the base member. Formed near the upper edge of the base member is a horizontally aligned, elongated oval-shaped slot. Formed near the upper edge and along the inside edge of each page is a horizontally aligned U-shaped slot. When the pages are placed over the front or back surfaces of the base member, the U-shaped slots are aligned and registered over the elongated slot on the base member thereby enabling the user to extend his or her fingers through the elongated and U-shaped slots to hold the lap counter with one hand.

Currently, the assistant must kneel down next to the side of the pool and, with one hand, hold the bottom edge of the lap counter 12 to 16 inches below the water line with his or her fingers extending through the elongated and U-shaped slots. The assistant must then lift the lap counter out of the water and adjust the location of his or her fingers in the slots so that the pages may be changed with his or her opposite free hand. When changing the pages, the assistant may accidentally drop the lap counter into the water. Also, while kneeling down, the assistant may be splashed, or fall into the water. Since swimmers often swim up to sixty laps, the act of repeatedly kneeling down and changing pages to insert or remove the lap counter from the water makes it likely that one of the two undesirable events will occur.

What is needed is a swimmer's lap counter device that uses a standard, flip-style lap counter that allows the assistant to easily change pages, reduces the possibility that the lap counter may be dropped into the water, and allows the user to stand upright while holding and removing the lap counter from the water. Such a device should also enable an assistant to lock the pages in place on the lap counter so they do not turn when the device is inserted or removed from the water.

SUMMARY OF THE INVENTION

It is an object of the present invention to provide a holding device for a manual, flip-style lap counter.

It is another object of the present invention to provide such a holding device that enables the user to stand upright adjacent to the edge of the pool and extend the lap counter into the water for viewing by the swimmer.

It is a further object of the invention that locks the pages on the lap counter in position as the device is inserted and removed form the water.

These and other objects of the invention which will become apparent are met by a swimmer's lap counter device used to inform swimmers of the number of laps they have completed. The device includes a planar body with parallel front and back surfaces and an upward extended neck. The neck has sufficient size and shape to act as a handle for holding the device with a lap counter attached thereto in the water. Formed inside the upper portion of the planar body and below the neck is a wide finger opening which allows the user to extend his or her fingers in the planar body to hold the device. Formed inside the neck is a threaded bore that may attach to an optional elongated pole that has sufficient length so that an assistant may stand upright adjacent to the edge of the pool and position the planar body at or below the water line.

The planar body has at least one outward extending, transversely aligned alignment member formed on each front and back surface. The alignment members are located directly opposite each other near the lower edge of the front and back surfaces. In the preferred embodiment, the front and back surfaces are recessed with their upper edge extending outward and acting as an abutment surface for the upper edge of the lap counter.

During use, the lap counter is longitudinally aligned and positioned over the front surface of the planar body so that the upper edges of the base member and pages in each stack are aligned with the upper edge of the recessed front surface. The upper elongated slot formed on the lap counter's base member and the U-shaped slots on the individual pages are aligned around the alignment member on the front surface. When the pages are turned, the U-shaped slots are aligned around the alignment member on the rear surface. The alignment members both extend outward a sufficient distance from the front and rear surfaces so they extend through all to the pages when stacked on the front and rear surfaces.

Attached to the front and rear surfaces is an adjustment knob that prevents the stacked pages from rotating when positioned around the alignment members. In the preferred embodiment, there are two pairs of adjustment knobs attached to the outer surface of each alignment member. Each alignment member is able to freely rotated 360 degrees between locking and non-locking positions. Also in the preferred embodiment, the alignment member located on the rear surface is located directly opposite the alignment member located on the front surface so that the lap counter's U-shaped slots may be aligned with the alignment member when the pages are rotated to the back surface. During use, the adjustment knobs are turned to a non-locking position so that the pages may be turned. The adjustment knobs are then turned to a locking position to prevent the pages in each stack on the lap counter from turning. In the preferred embodiment, the two adjustment knobs on the front surface are coupled to the two adjustment knobs located on the back surface of the planar body so that the pages located on both surfaces can be simultaneously locked or unlocked.

DESCRIPTION OF THE PREFERRED EMBODIMENT(S)

Figure 1:
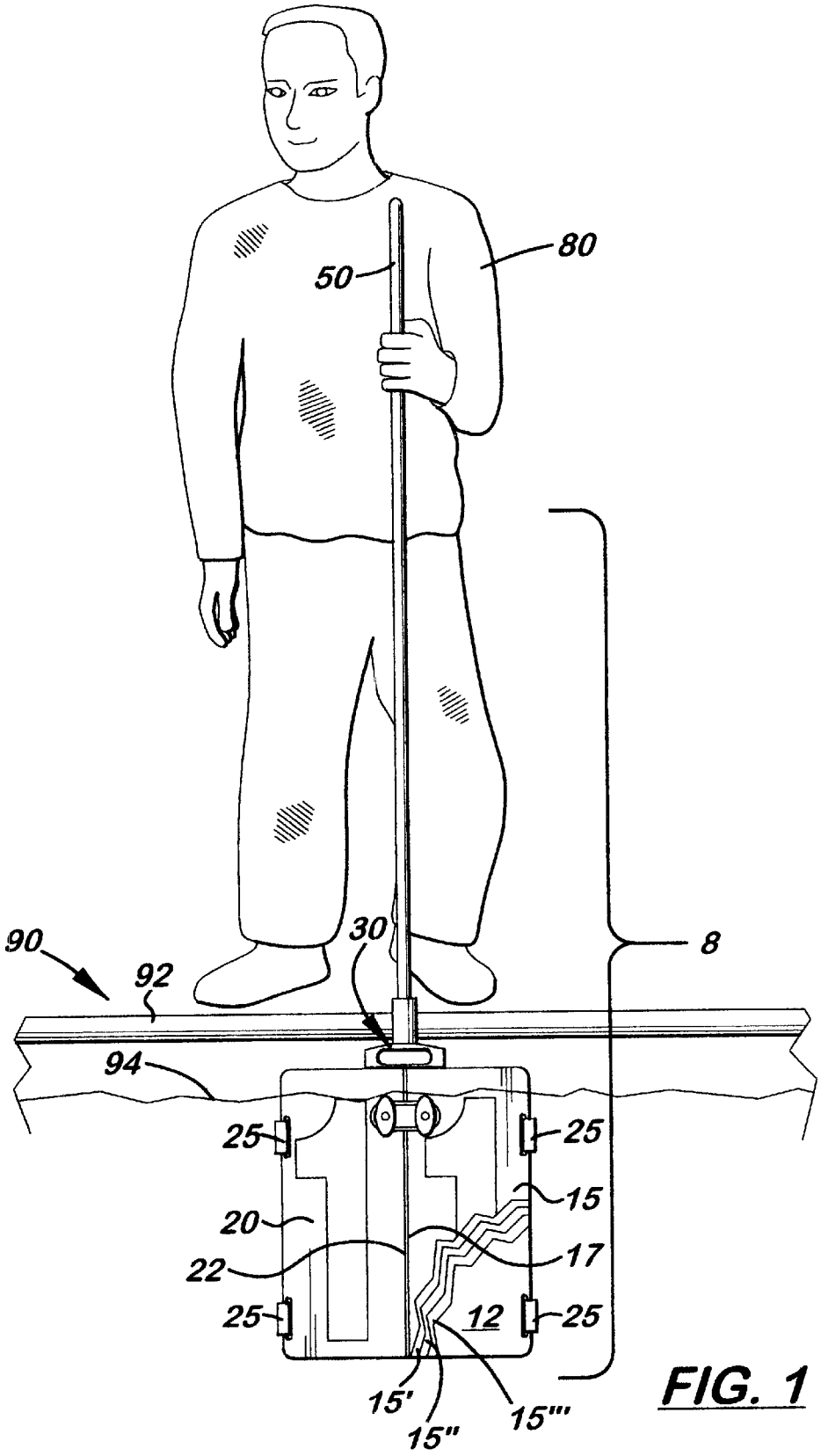
FIG. 1 is a perspective view of a swimmer's assistant holding the holding device with a manual, flip-style lap counter attached thereto.

Referring to the accompanying FIGS. 1–4, there is shown and described a lap counter device 8 conveniently operated by a swimmer's assistant 80 to show a swimmer how many laps he or she has swum. The device 8 includes a manual, flip-style lap counter 10 and a rigid, planar body 30 designed to hold the lap counter 10 for viewing by a swimmer. The planar body 30 has an upward extended neck 32 with a bore 34 having internal threads 36 formed inside the neck 32 that attaches to external threads 52 located on the distal end of an elongated pole 50. In the preferred embodiment, the elongated pole 50 has sufficient length so that it may be used as a handle for an assistant 80 to hold the planar body 30 at or below the water line 94 while standing next to the edge 92 of the pool 90 as shown in FIG. 1.

Figure 2:
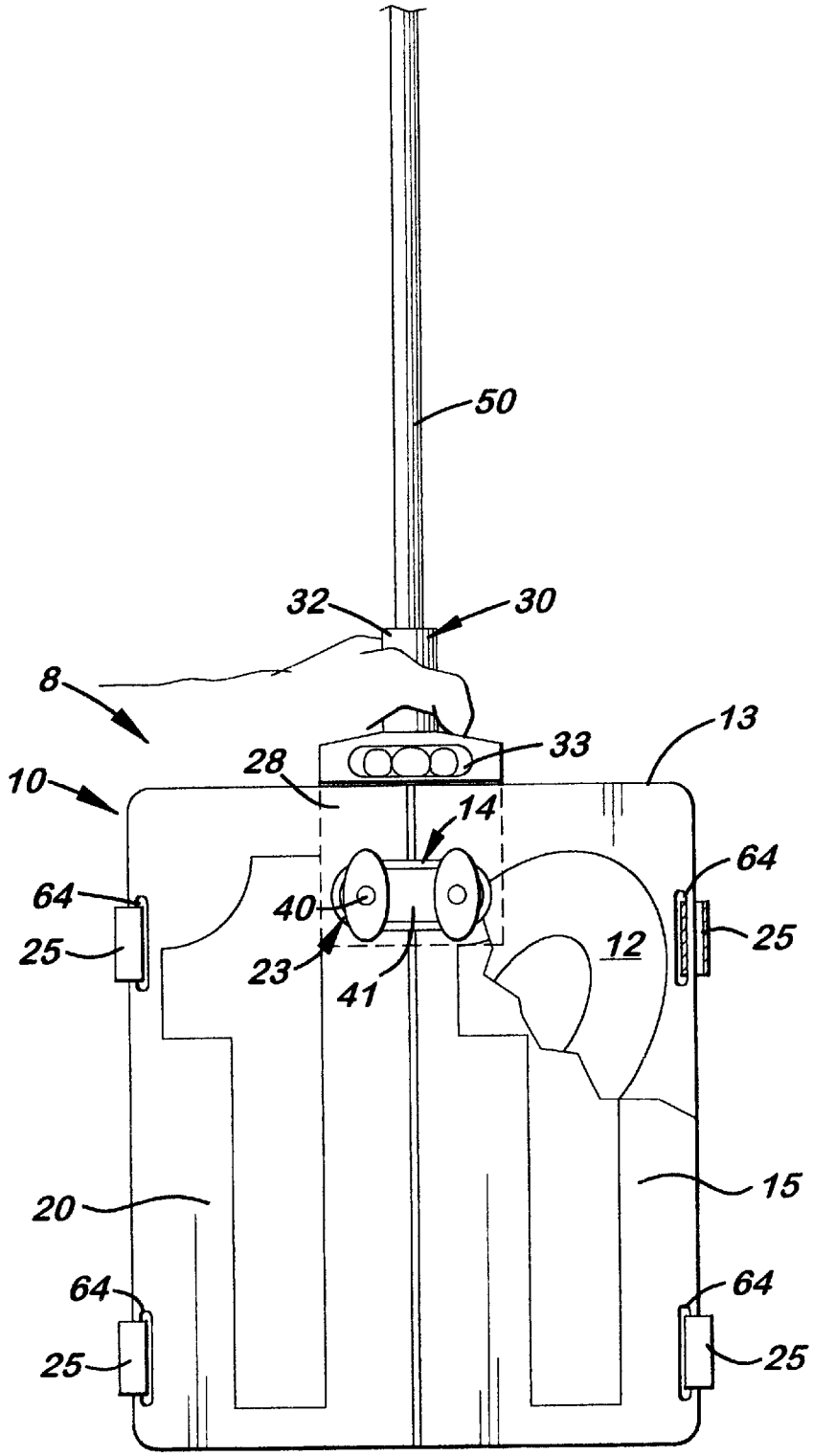
FIG. 2 is a front elevational view of the holding device with the lap counter attached thereto.
Figure 3:
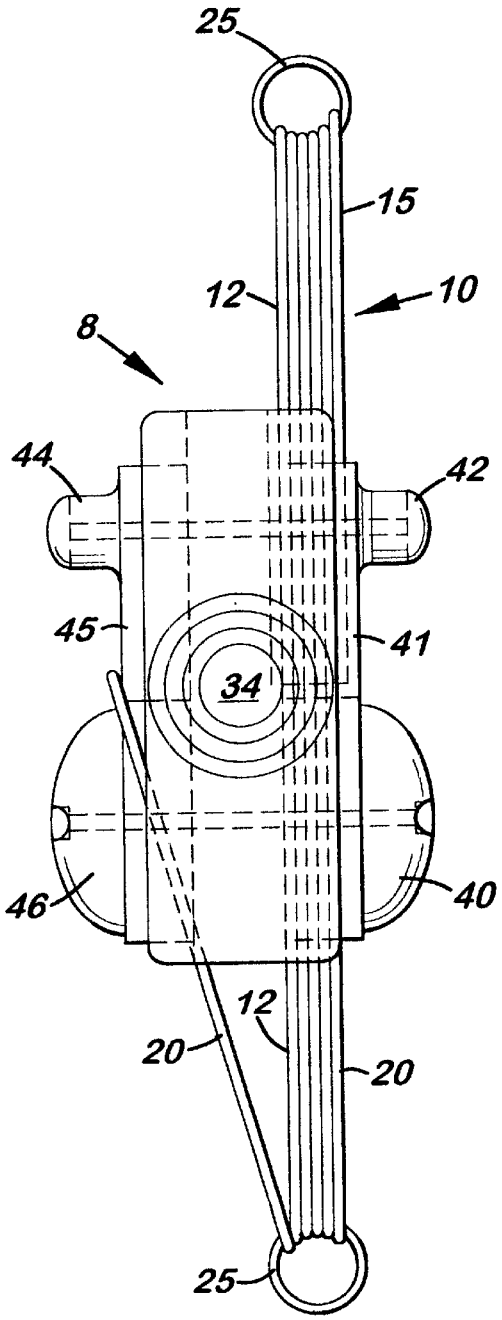
FIG. 3 is a side elevational view of the holding device shown in FIG. 2.
Figure 4:
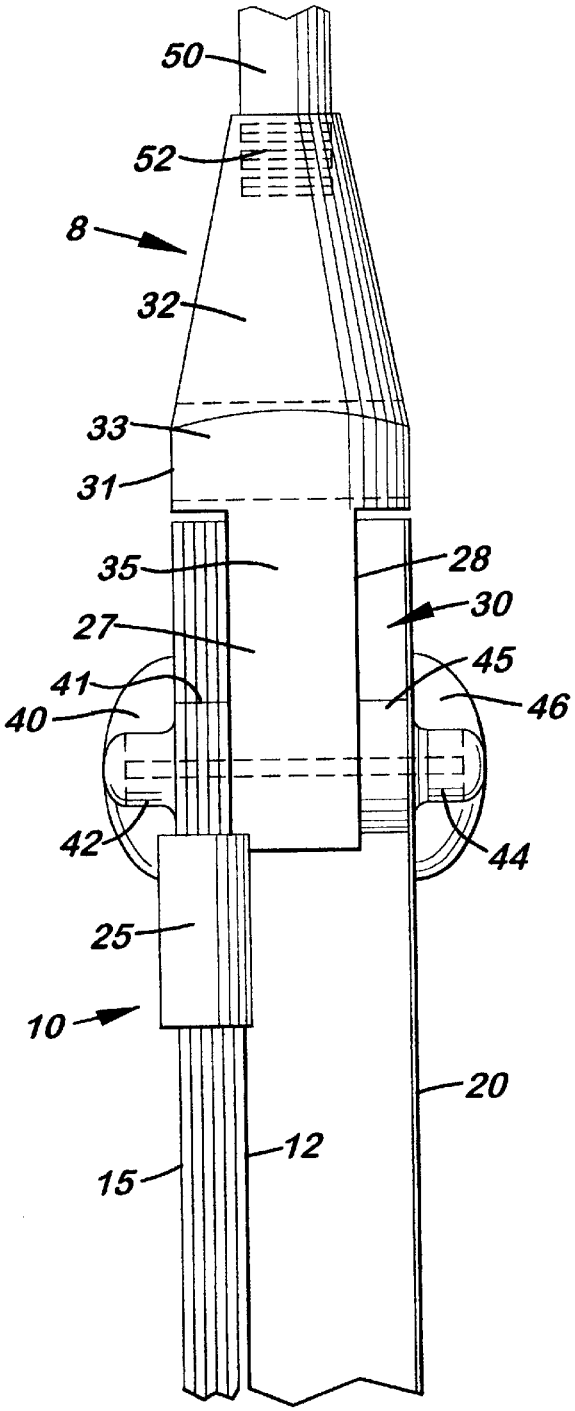
FIG. 4 a top plan view of the holding device showing the flipped pages positioned on the back surface of the holding device.

As shown in FIG. 2, the lap counter 10, which is incorporated by reference herein, comprises two stacks of pages 15, 20 pivotally connected along their outside edges to a lower, planar base member 12. Formed centrally and near the upper edge of the base member 12 is a horizontally aligned elongated slot 33. Each page 15, 20 is rectangular with parallel upper and lower edges and parallel inside and outside edges. Formed near the two outside edges of the base member 12 and the outside edge of each page 15, 20 are two vertically aligned slots 64. During assembly, the slots 64 on the pages 15, 20 are aligned and registered with the slots (not shown) on the base member 12. A cylindrical ring member 25 extends through the slots 64 to pivotally connect the pages 15, 20 to the base member 12. Formed near the upper edge 13 of the base member 12 is a horizontally aligned, oval-shaped elongated slot (not shown). Formed near the upper edge and along the inside edge 17, 22 of each page 15, 20, respectively, is a horizontally aligned, U-shaped slot (slot 23 shown only). The U-shaped slots on opposite pages are longitudinally aligned to form an elongated slot registered and approximately equal in size to the elongated slot formed on the base member 12. When attached to the planar body 30, the elongated and U-shaped slots 18, 23 receive the elevated front and rear alignment members 41, 45 on the front and rear surfaces 27, 28, respectively, as discussed further below.

Typically, the lap counter 10 is used to indicate up to 69 total laps. There are six left pages 20 which indicate the single digits one through five. The first left page 20 is blank and the digit six is printed on the front surface of the base member 12 directly under the last page 20. There are four pages 15 on the right side with the single digits one, three, five, seven, and nine, respectively, printed thereon. Printed on the front surface of the base member 12 under the last page 15 is the digit nine.

In the preferred embodiment, the planar body 30 includes a thicker upper portion 31 and a thin lower portion 32. The lower portion includes a parallel recessed front surface 27 and a recessed rear surface 28. Formed near the lower edge of each front and rear surface 27, 28, respectively, is a transversely aligned, outward and inward extending alignment member 41, 45, respectively. Each alignment member 41, 45 is oval, slightly smaller and complementary in shape to the elongated slot on the base member 12 and the two U-shaped slots 18, 23 formed on the pages 15, 20 of the lap counter 10. The sides of the alignment members 41, 45 are perpendicular to the front and rear surfaces 27, 28. During use, the alignment members 41, 45 extend through the two U-shaped slots 18, 23 to help keep all of the pages 15, 20 properly aligned on the planar body 30. The upper edge of the front and rear surfaces 27, 28, respectively, extends fully across the planar body 30 and acts as an abutment for the top edge of the lap counter 10.

Attached to the outer surface of each alignment member 41, 45 is a pair of adjustment knobs 40, 42 and 44, 46, respectively. The pairs of adjustment knobs are positioned on each alignment member so that they extend through the U-shaped slots 18, 23 when position over the front and rear surfaces. In the preferred embodiment, the adjustment knobs 40, 42 and 44, 46 are oval in shaped and size so that they may rotate to lock or unlock the pages 15, 20 on the planar body 30. In the preferred embodiment, each adjustment knob 41, 45 on the front alignment member is coupled to opposite adjustment knob 44, 46 on the rear alignment member.

Formed near the upper neck on the planar body 30 is a transversely aligned, wide finger slot 33 that fully extends through the planar body 30. The slot 33 enables an assistant 80 to securely hold the planar body 30 with one hand by placing the neck into the user's palm and extending his or her fingers into the slot 33. The opposite hand can then be used to control the adjustment knobs and turn the pages 15, 20.

The planar body 30 is made of lightweight, water-resistant material, such as fiberglass or plastic. In the preferred embodiment, the planar body 30 measures approximately 5 inches in length, 3½ inches in width, and 1½ inches in height. The adjustment knobs 40, 42 and 44,46 are oval and measure approximately 1¼ inch in length, and ½ inch in width. The adjustment knobs 40, 42 and 44, 46 are approximately 1¾ inches apart on the alignment members 41, 45, respectively. The elongated slot 33 is oval in shape and measures approximately 2¼ inches in width and ¾ inch in length at its center axis. The neck 32 measures approximately 2 inches in length and 1½ inches in diameter. The height of the alignment members 41, 45 is approximately ⅝ inch.

The elongated pole 50 measures approximately 60 inches in length and ¾ inch in diameter.

During use, the pages 15, 20 of the lap counter holding device 10 are vertically positioned on the planar body 30 so that the upper edges of the base member 12 and pages 15, 20 are adjacent to the upper edge of the front surface 27, and the elongated slot on the base member 12 and the upper slots 18, 23 formed on the pages 15, 20 are aligned around the elevated alignment member 41. The pages 15, 20 are pressed inward against the front recessed surface 27 so that the adjustment knobs 40, 42 extend through the U-shaped slots 18, 23, respectively. The adjustment knobs 40, 42 are selectively turned from a blocking to a non-blocking position, which allows the pages 15, 20 to be securely held in position on the body 30 when placed in the water or manually turned to indicate a new lap, or rotated and positioned over the rear surface. Because the adjustment knobs 40 and 42 are coupled to adjustment knobs 44 and 46 on the rear alignment member, respectively, the user only has to rotate adjustment knobs 40 and 42 to lock and unlock the pages 15, 20 on both sides of the planar body 30.

In compliance with the statute, the invention has been described herein in language more or less specific as to structural features. It should be understood, however, that the invention is not limited to the specific features shown, since the means and construction shown comprise only the preferred embodiments for putting the invention into effect. The invention is therefore claimed in any of its forms or modifications within the legitimate and valid scope of the amended claims, appropriately interpreted in accordance with the doctrine of equivalents.

I claim:

1. A swimmer's lap counter device, comprising:

a. a flip-style lap counter, said lap counter including two parallel stacks of pages with numbers printed thereon, each said page in each said stack of pages being pivotally connected together along its distal edge enabling said pages in each stack to be turned to display a number printed on the lower adjacent said page, each said page including a free proximal edge with a transversely aligned, U-shaped slot formed therein; and, b. a planar body used to hold said lap counter, said planar body including parallel front and back surfaces, said planar body including at least one pair of locking means that extend through said U-shaped slots formed on said pages to selectively lock said pages over said front surface and said back surface of said planar body; and, c. an alignment member formed on said front surface that extends through said U-shaped slot on said page when disposed over said front surface, thereby enabling said pages to be longitudinally aligned on said front surface of said planar body.

2. The lap counter device, as recited in claim 1, wherein said locking means is at least two adjustment knobs attached to said planar body capable of being selectively adjusted to lock and unlock over said pages over said front surface of said planar body.

3. The lap counter device, as recited in claim 2, further including a second pair of adjustment knobs located on said rear surface of said planar body to lock and unlock said pages over said rear surface.

4. The lap counter device, as recited in claim 3, wherein said adjustment knobs on said front surface and said rear surface are coupled together.

5. The lap counter device, as recited in claim 2, further including an alignment means on and said back surface of said planar body to keep said lap counter aligned on said back surface of said planar body.

6. The lap counter device, as recited in claim 5, wherein said alignment means is an elevated alignment member disposed transversely on said front surface and said rear surface of said planar body.

7. The lap counter device, as recited in claim 1, further including an upward neck formed on said planar body enabling said planar body to be held in one hand.

8. The lap counter device, as recited in claims 7, further including an elongated pole attached to said planar body.

9. The lap counter device, as recited in claim 8, further including a pole attachment means disposed between said pole and said neck to enable said pole to be selectively attached to said neck.

10. The lap counter device, as recited in claim 7, further including a finger slot formed on said planar body.

11. A swimmer's lap counter device, comprising:

a. a flip-style lap counter, said lap counter including two parallel sets of pages with numbers printed thereon, each page being pivotally attached along its distal edge enabling said page to be turned to display the number on the adjacent page;

b. a body used to hold said lap counter in a vertical position, said body including parallel front and back surfaces, said body including an alignment member used to keep said lap counter vertically aligned there and including at least one pair of locking means to selectively lock adjacent pages on said lap counter over said front surface and a second pair of locking means to selectively block the pages on said lap counter in position over said rear surface of said body; and, c. a pole attached to said body.

12. The lap counter device, as recited in claim 11, further including an upward extending neck formed on said body.

13. The lap counter device, as recited in claim 11, further including a finger passageway aligned perpendicular to said front and back surfaces of said body to enable a user to manually hold said body.

14. The lap counter device, as recited in claim 11, wherein said first pair of said of locking means is coupled to said second pair of locking means.

15. A swimmer's lap counter device for holding a flip-style lap counter having two parallel stacks of pages with numbers printed thereon, said device comprising:

a. a planar body having an upper section and a lower section with opposite and parallel front and rear surfaces;

b. elevated alignment members formed on each said front surface and said rear surface of said planar body enabling a lap counter to be disposed over said front surface of said planar body;

c. a pair of adjustment knobs located on each said alignment member capable of being moved between locked and unlocked positions on said front surface and said rear surface.

16. The lap counter device, as recited in claim 15, further including a finger slot formed on said upper section of said planar body, said finger slot being aligned perpendicular to said front and rear surface of said planar body to enable a user to insert at least one finger into said finger slot and manually hold said planar body.

17. The lap counter device, as recited in claim 15, wherein said adjustment knobs located opposite said front surface and said rear surface are coupled together.

18. The lap counter device, as recited in claim 15, further including a pole attachment means disposed between said pole and said neck to enable said pole to be selectively attached to said neck.

* * * * *